US006232931B1

(12) United States Patent
Hart

(10) Patent No.: US 6,232,931 B1
(45) **Date of Patent: *May 15, 2001**

(54) OPTO-ELECTRONICALLY CONTROLLED FREQUENCY SELECTIVE SURFACE

(75) Inventor: Stephen M. Hart, San Diego, CA (US)

(73) Assignee: The United States of America as represented by the Secretary of the Navy, Washington, DC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/253,504

(22) Filed: Feb. 19, 1999

(51) Int. Cl.[7] ..... H01Q 15/02
(52) U.S. Cl. ..... 343/909; 343/776; 343/788
(58) Field of Search ..... 343/767, 770, 343/772, 795, 764, 909, 776, 788; 359/245; H01Q 15/02

(56) References Cited

U.S. PATENT DOCUMENTS

| | | | | |
|---|---|---|---|---|
| 3,919,699 | | 11/1975 | Hartemann . | |
| 4,476,471 | | 10/1984 | Sato et al. . | |
| 4,809,011 | | 2/1989 | Kunz . | |
| 5,170,169 | | 12/1992 | Stephan . | |
| 5,185,613 | | 2/1993 | Whatmore et al. . | |
| 5,208,603 | | 5/1993 | Yee . | |
| 5,262,796 | | 11/1993 | Cachier . | |
| 5,264,859 | | 11/1993 | Lee et al. . | |
| 5,278,562 | | 1/1994 | Martin et al. . | |
| 5,298,909 | | 3/1994 | Peters et al. . | |
| 5,307,077 | | 4/1994 | Branigan et al. . | |
| 5,400,043 | | 3/1995 | Arceneaux et al. . | |
| 5,402,132 | | 3/1995 | Hall et al. . | |
| 5,436,453 | | 7/1995 | Chang et al. . | |
| 5,563,614 | * | 10/1996 | Alden et al. | 343/701 |
| 5,621,423 | * | 4/1997 | Sureau | 343/909 |
| 5,892,485 | * | 4/1999 | Glabe et al. | 343/789 |
| 5,917,458 | * | 6/1999 | Ho et al. | 343/909 |
| 5,949,387 | * | 9/1999 | Wu et al. | 343/909 |
| 5,959,309 | * | 9/1999 | Tsui et al. | 257/48 |
| 6,028,692 | * | 2/2000 | Rhoads et al. | 359/245 |

* cited by examiner

*Primary Examiner*—Don Wang
*Assistant Examiner*—Shih-Chao Chen
(74) *Attorney, Agent, or Firm*—Harvey Fendelman; Peter A. Lipovsky; Michael A. Kagan

(57) ABSTRACT

An optically controlled frequency selective surface (FSS) includes an electrically conductive layer having an array of radio frequency scattering elements such as slots formed in an electrically conductive layer or loops mounted to a substrate. Photonically controlled elements, such as photodiodes, photo-transistors, and other photo-electronic devices, are connected across each of the scattering elements. Electromagnetic characteristics of the FSS, including resonant frequency, impedance, and the pass/stop band, may be modulated by controlling the degree of illumination of the photonically controlled elements.

8 Claims, 10 Drawing Sheets

OPTO-ELECTRONICALLY CONTROLLED FREQUENCY SELECTIVE SURFACE

The present invention relates to frequency selective surfaces, and more particularly, to a frequency selective surface having frequency response characteristics which are opto-electronically modulated by selectively illuminating photonically controlled elements connected across frequency scattering elements integrated in the surface.

BACKGROUND OF THE INVENTION

Frequency selective surfaces (FSS) are used as filters through which electromagnetic energy within a specific frequency range and having a prescribed polarization may be selectively propagated or not propagated. FSSs generally consist of an electrically conductive layer in which patterns of frequency scattering elements, generally in the form of apertures, are formed. The electrically conductive layer is usually supported by a dielectric substrate.

Radomes are enclosures, which protect antennas from the environment and may incorporate FSSs. A typical radome is constructed of a dielectric layer or a combination of dielectric layers which include an FSS to provide frequency selective attributes. However, the FSS is in general static, yielding a fixed pass/stop band performance. A further limitation of conventional radomes is that the enclosed antenna is exposed to many different types of electromagnetic threats, i.e., jammers generating signals in the operating band of the antenna. The radome must pass signals in the antenna operational frequency band for proper functioning of the antenna and associated systems. This exposes the enclosed antenna to jamming signals and other types of interference. Therefore, it is desirable to be able to selectively filter out signals having particular wavelengths over certain intervals of time (e.g., when the enclosed antenna is non-operating or receiving only at a particular wavelength). Moreover, a further need exists for an FSS that has frequency scattering characteristics that may be selectively modulated in time.

SUMMARY OF THE INVENTION

The present invention provides an opto-electronically controlled frequency selective surfaces (FSS) comprising an array of radio frequency scattering elements which may be implemented as slots formed in an electrically conductive layer mounted to a supporting substrate. In another aspect of the invention, the radio frequency scattering elements may be formed of electrically conductive loops mounted to a dielectric substrate. One or more photonically controlled elements (PCE) connected to each of the radio frequency scattering elements may be selectively illuminated to modulate the frequency characteristics of the frequency scattering elements, and hence, of the FSS.

An important advantage of the present invention is that it provides an FSS having a pass/stop band that may be modulated by illuminating specific areas of the surface. This feature is important because it makes the system physically realizable and not excessively costly.

BRIEF DESCRIPTION OF THE FIGURES

Throughout the several views, like elements are referenced with like reference numerals.

DESCRIPTION OF THE PREFERRED EMBODIMENT

Figure 1:
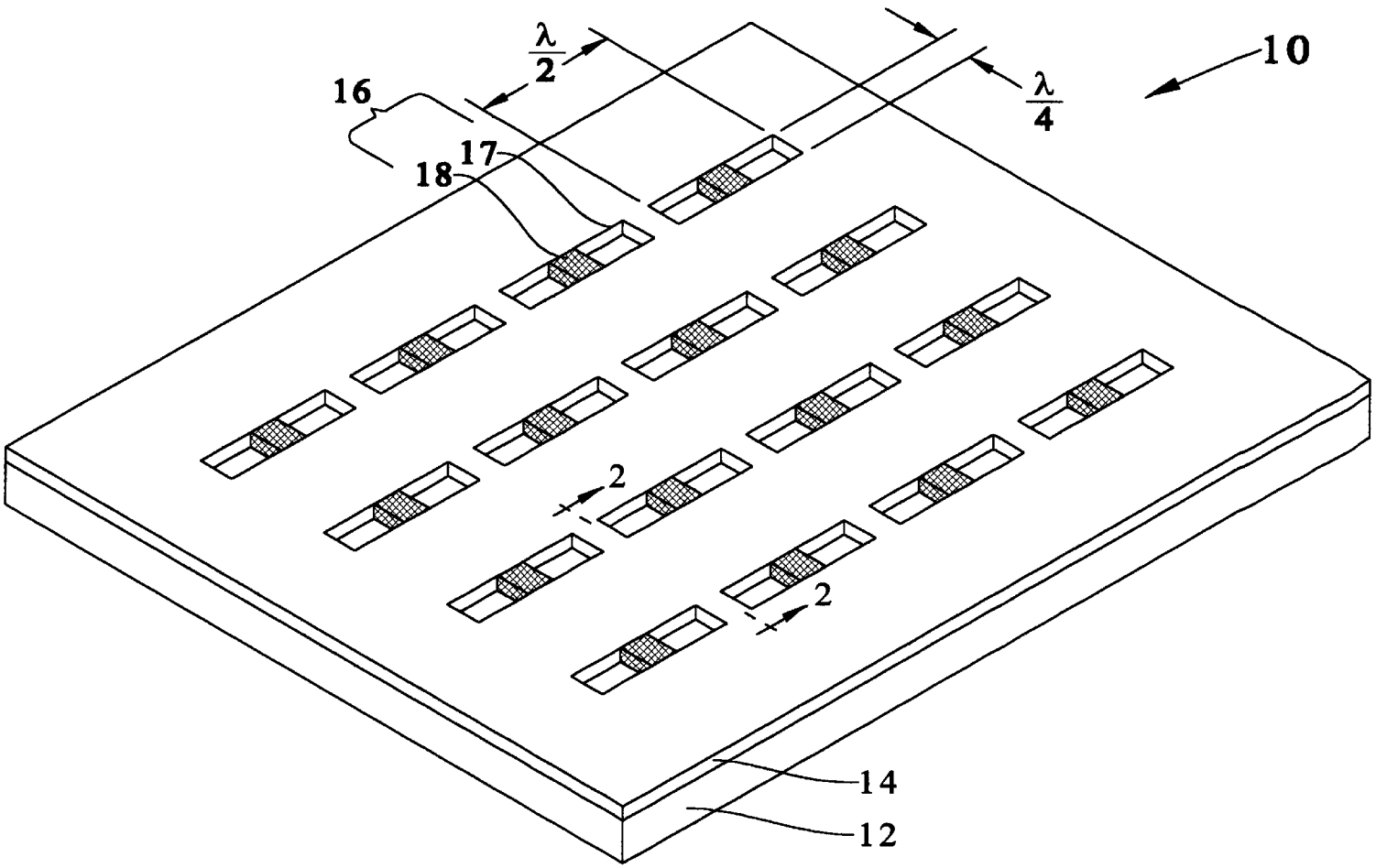
FIG. 1 shows an opto-electronically controlled frequency selective surface embodying various features of the present invention.

Referring to FIG. 1, the present invention provides an opto-electronically controlled frequency selective surface 10 which includes a substrate 12 on which is mounted an electrically conductive layer 14. An array of frequency scattering elements 16, generally implemented as slots 17, are formed in the electrically conductive layer 14.

Figure 2:
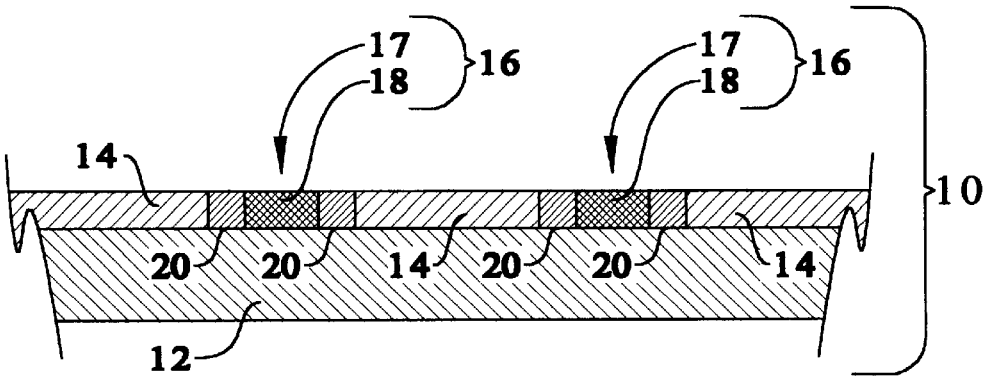
FIG. 2 is a cross-sectional view of the opto-electronically controlled frequency selective surface taken along view 2—2 shown in FIG. 1.

Each frequency scattering element 16 includes a photonically controlled element (PCE) 18 functionally coupled across each slot 17. Upon illumination by a light source, not shown, the various PCEs 18 change their impedance, and hence, the scattering frequency of the surface 10. Each slot 17 when shaped as a rectangle may have a length of about $\lambda/2$, where $\lambda$ represents the center wavelength of electromagnetic energy for which the radio frequency surface 10 is designed to operate, and may have a width of about $\lambda/4$. PCEs 18 may be connected across one or more of the slots 17 as shown in FIG. 2. Metal leads 20 may interconnect each PCE 18 across a slot 17 between electrically conductive layer 14. Elements 18 may be implemented as discrete components or may be manufactured using standard photolithographic techniques.

In the preferred embodiment, substrate 12 preferably a dielectric material such as foam, phenolic, sapphire, glass, quartz, or silicon dioxide. However in some applications, substrate 12 may consist of a semiconducting material such as silicon. By way of example, electrically conductive layer 14 may be made of copper or a copper alloy having a thickness of about 0.005 inches which is bonded to substrate 12, such as dielectric material consisting essentially of HT-70 PVC foam, using NB102 adhesive applied at about 0.060 lbs/in$^2$.

Figure 3:
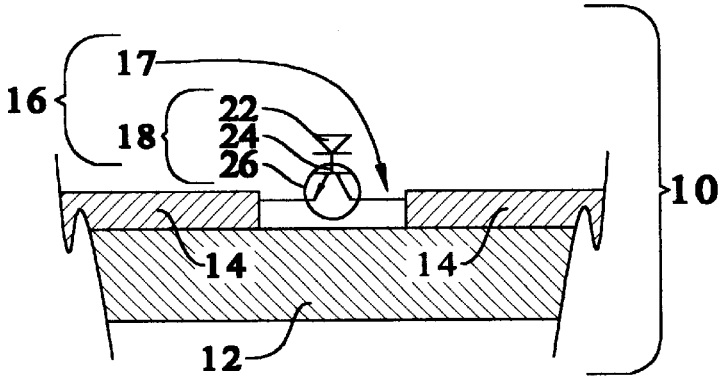
FIG. 3 shows a PCE connected to the gate of a field effect transistor.

Illumination of specific areas of the surface 10 causes illuminated PCEs 18 to exhibit a change in impedance, which in turn creates either a radio frequency (RF) pass or stop band in the illuminated region by varying the effective frequency and scattering cross-section of the affected frequency scattering elements 16. PCEs 18 may be implemented as bulk semiconductor switches, photo-cells, photodiodes, photo-transistors, and field effect transistors (FETs) each having a switching finction controlled by modulating its gate by one of the aforementioned devices. The FETs may be any one of the following photo controlled devices such as high electron mobility transistors (HEMTs), metal semiconductor field effect transistors (MESFETs), metal oxide semiconductor field effect transistors (MOSFETs), and the like. By way of example, PCEs 18 may be implemented as a photodiode 22 connected to a gate 24 of a field effect transistor 26, of the type identified above, as shown in FIG. 3.

Figure 4:
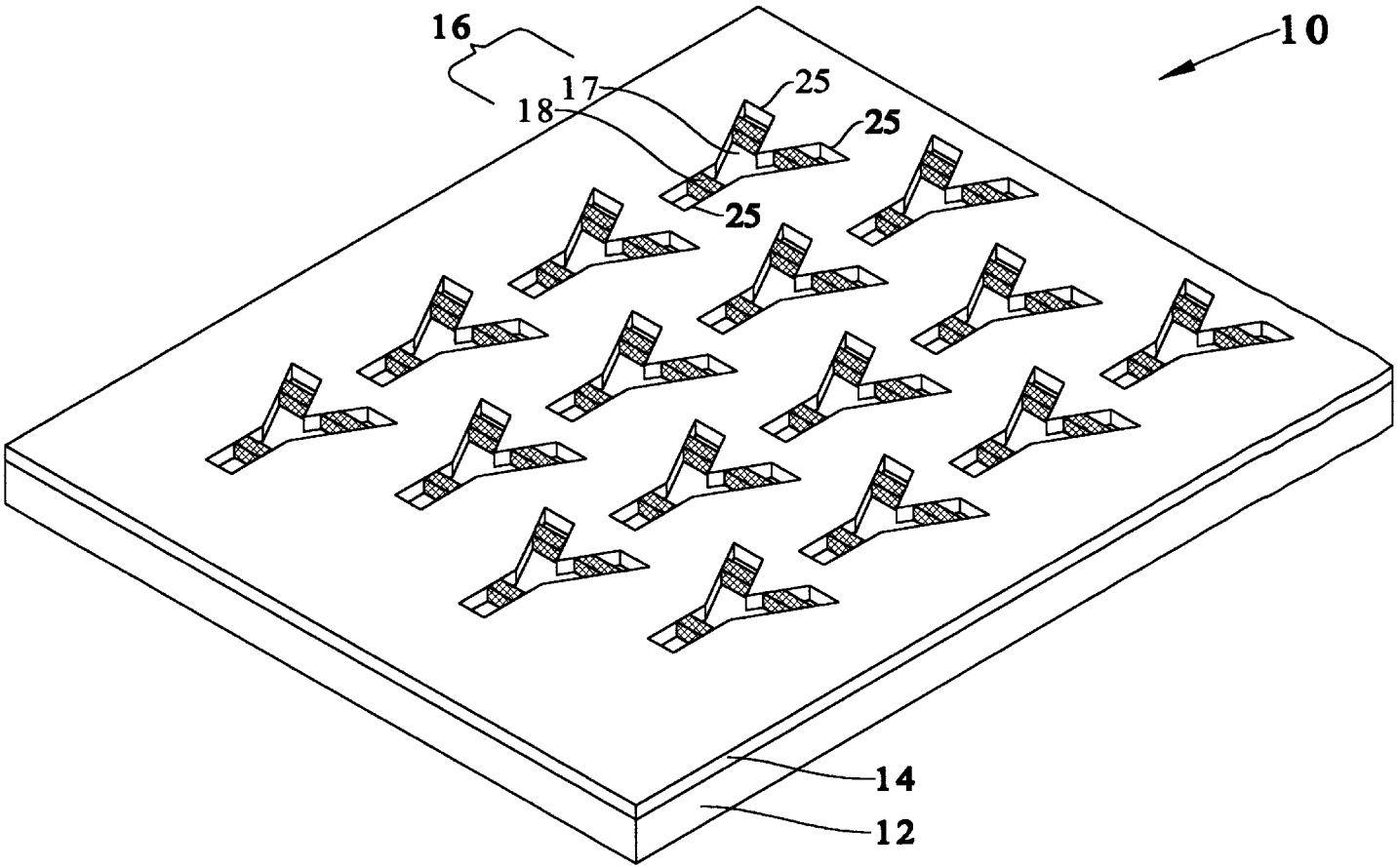
FIG. 4 shows an opto-electronically controlled frequency selective surface having Y-shaped slot type radio frequency scattering elements.
Figure 5:
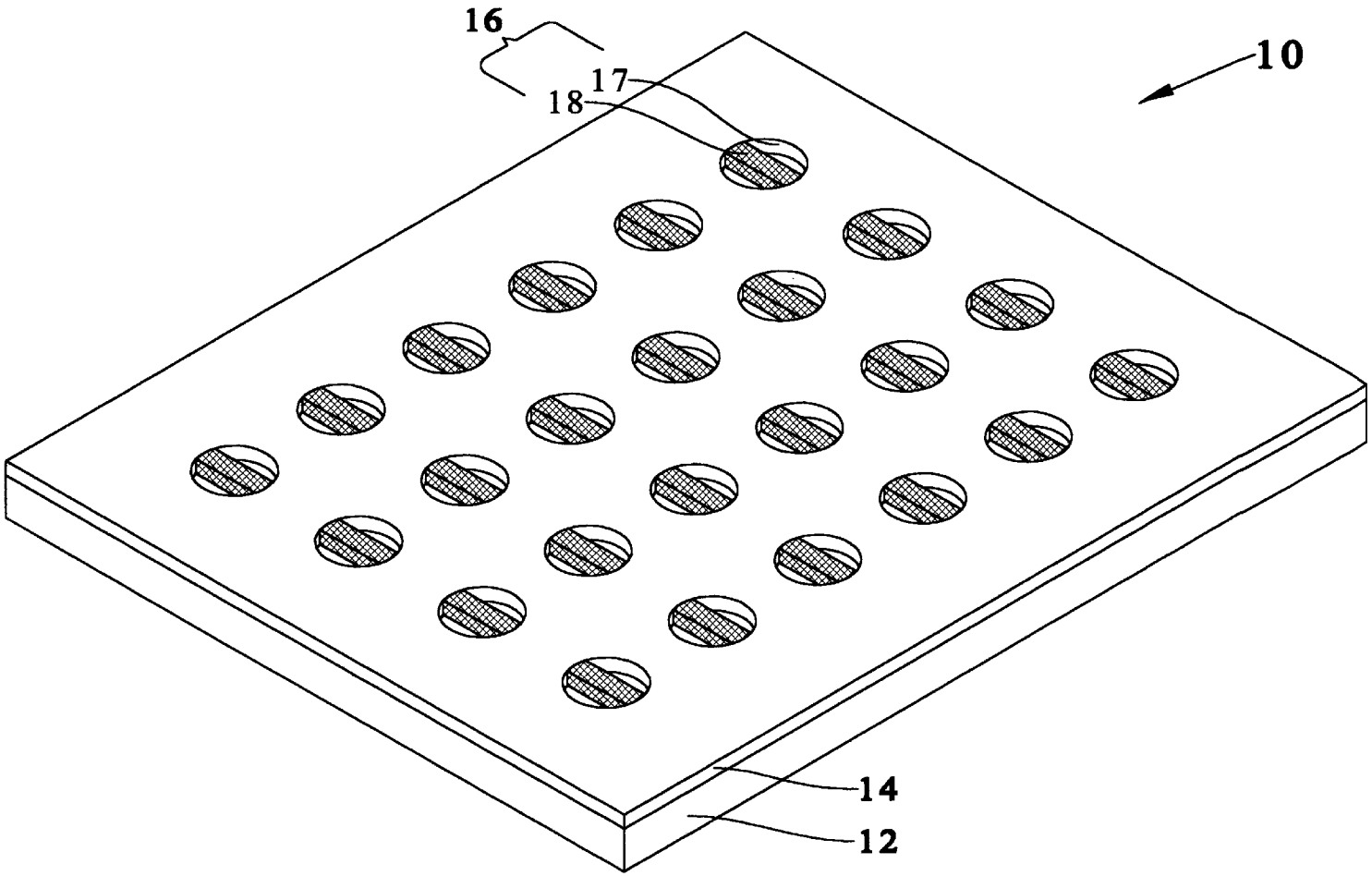
FIG. 5 shows an opto-electronically controlled frequency selective surface having circularly-shaped slot type radio frequency scattering elements.
Figure 6:
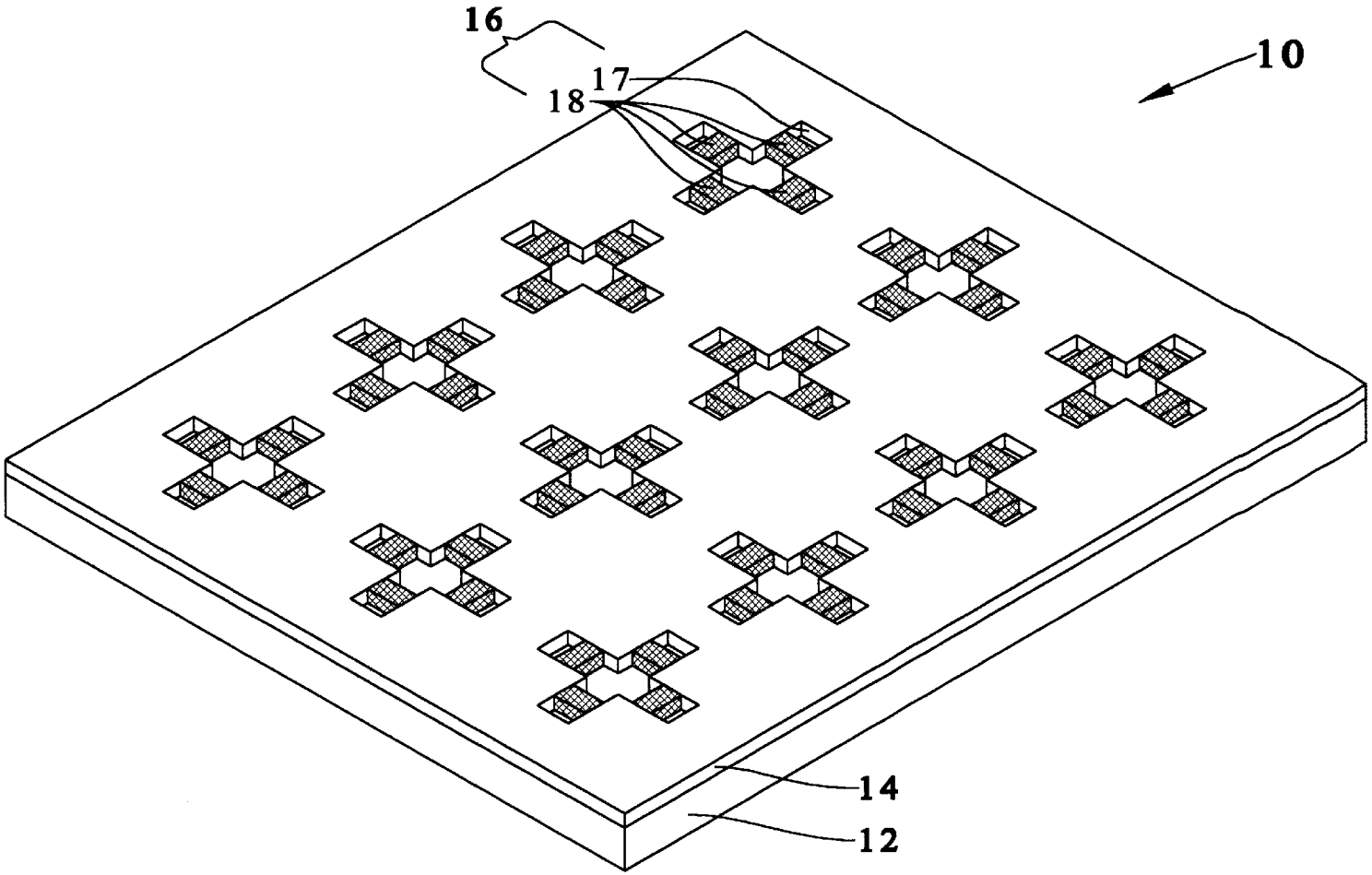
FIG. 6 shows an opto-electronically controlled frequency selective surface having cross-shaped slot type radio frequency scattering elements.

Slots 17 may be configured in many different type of shapes. For example, slots 17 may be: a) Y-shaped slots with a PCE 18 connected across one or more legs 25 comprising each Y-shaped slot as shown in FIG. 4; b) circularly shaped slots with PCE 18 connected diametrically across the slot as shown in FIG. 5; or c) cross-shaped slots with a PCE 18 connected across one or more legs 27 comprising the cross-shaped slot as shown in FIG. 6. Also, slots 17 may be polygonal shaped or shaped as bow-ties. Typical dimensions for the various shapes of radio frequency scattering elements 16 are provided in commonly assigned U.S. patent application Ser. No. 08/525,802, Frequency Selective Surface Integrated Antenna System, filed Sep. 8, 1995 and incorporated herein by reference.

Figure 7:
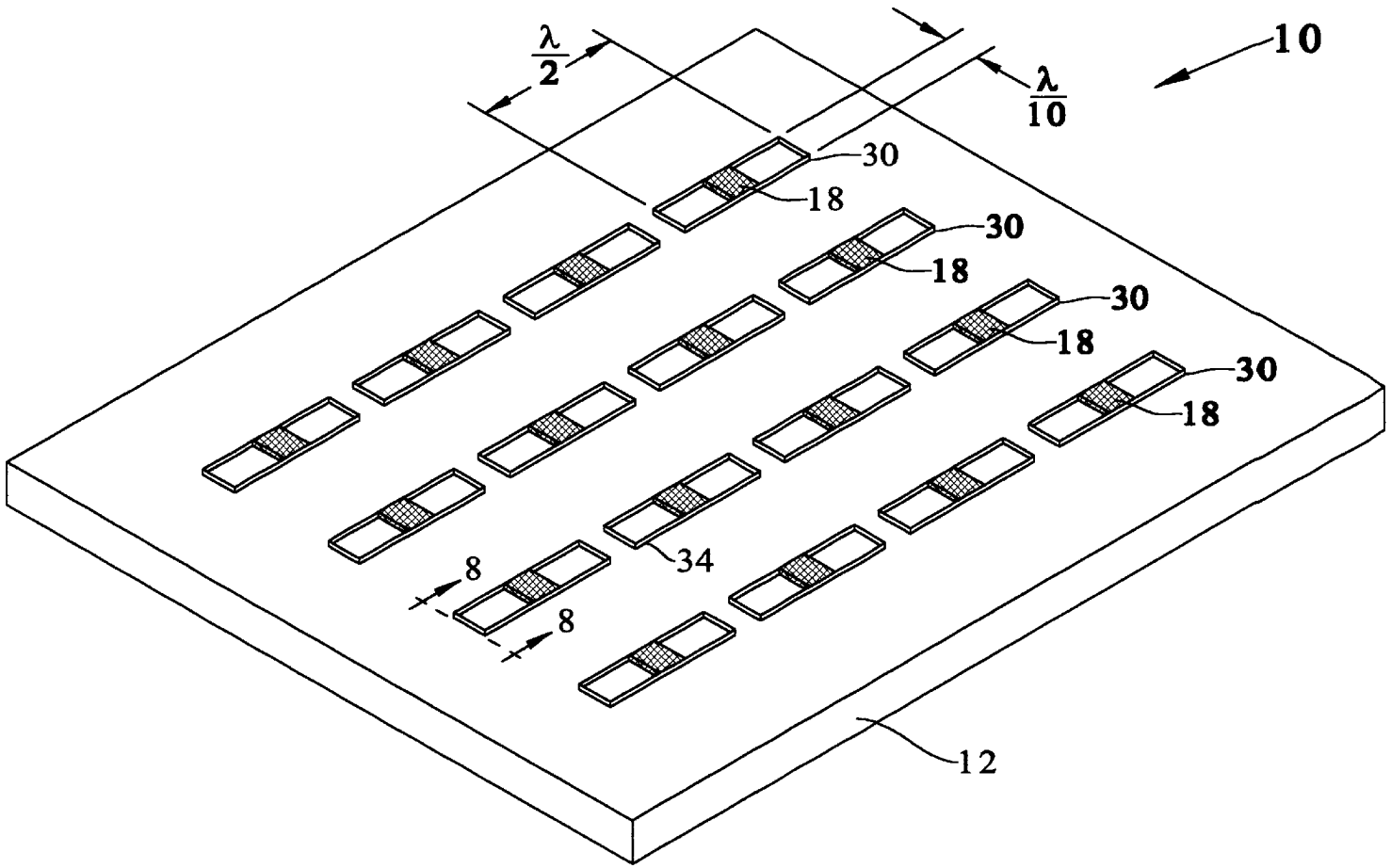
FIG. 7 shows an opto-electronically controlled frequency selective surface having rectangularly shaped loop type radio frequency scattering elements.

In another aspect of the invention, opto-electronically controlled frequency selective surface 10 includes an array of radio frequency scattering elements 30 supported on substrate 12. The radio frequency scattering elements 30 each include a loop 34 made of electronically conductive materials and a PCE 18 interconnected across the loop 34 for changing the loop impedance. PCEs 18 may be electrically connected in a series or shunt configuration, or even some combination of both. Referring to FIG. 7, loops 34 may be made of tracks of electrically conductive or semiconducting leads 32 formed on the substrate 12, as for example, using standard photolithographic techniques, and may be consist of electrically conducting or semiconducting materials such as gold, aluminum, polysilicon, and the like. PCE 18 is interconnected across loop 34 preferably with metallic leads 32. Modulation of the illumination of PCEs 18 changes the voltage and current applied to PCEs 18, thereby changing their impedance and, in turn, the scattering frequency and effective cross-sectional area of frequency scattering elements 30.

Figure 8:
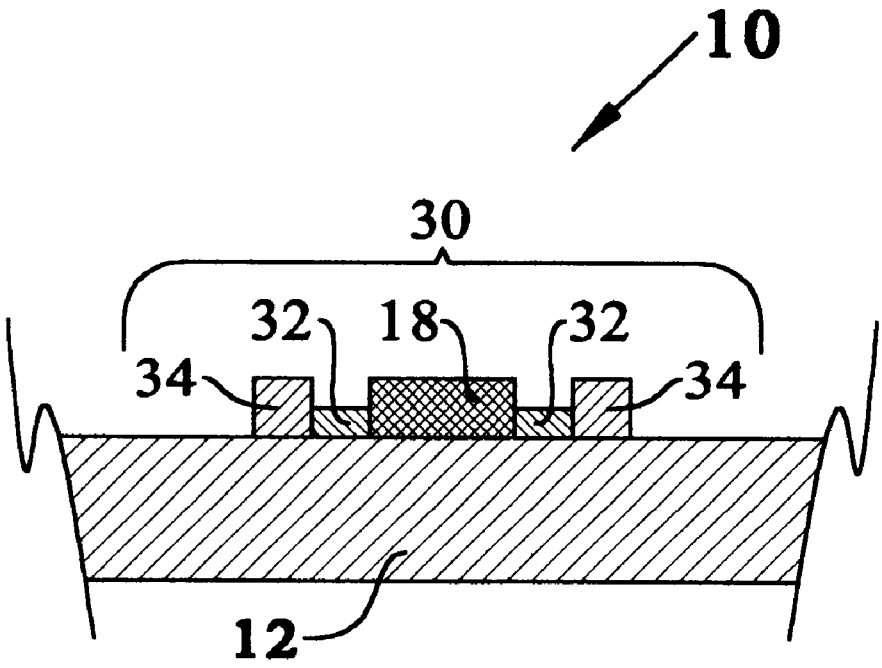
FIG. 8 shows a cross-sectional view of the opto-electronically controlled frequency selective surface of FIG. 7 taken along view 8—8.
Figure 9:
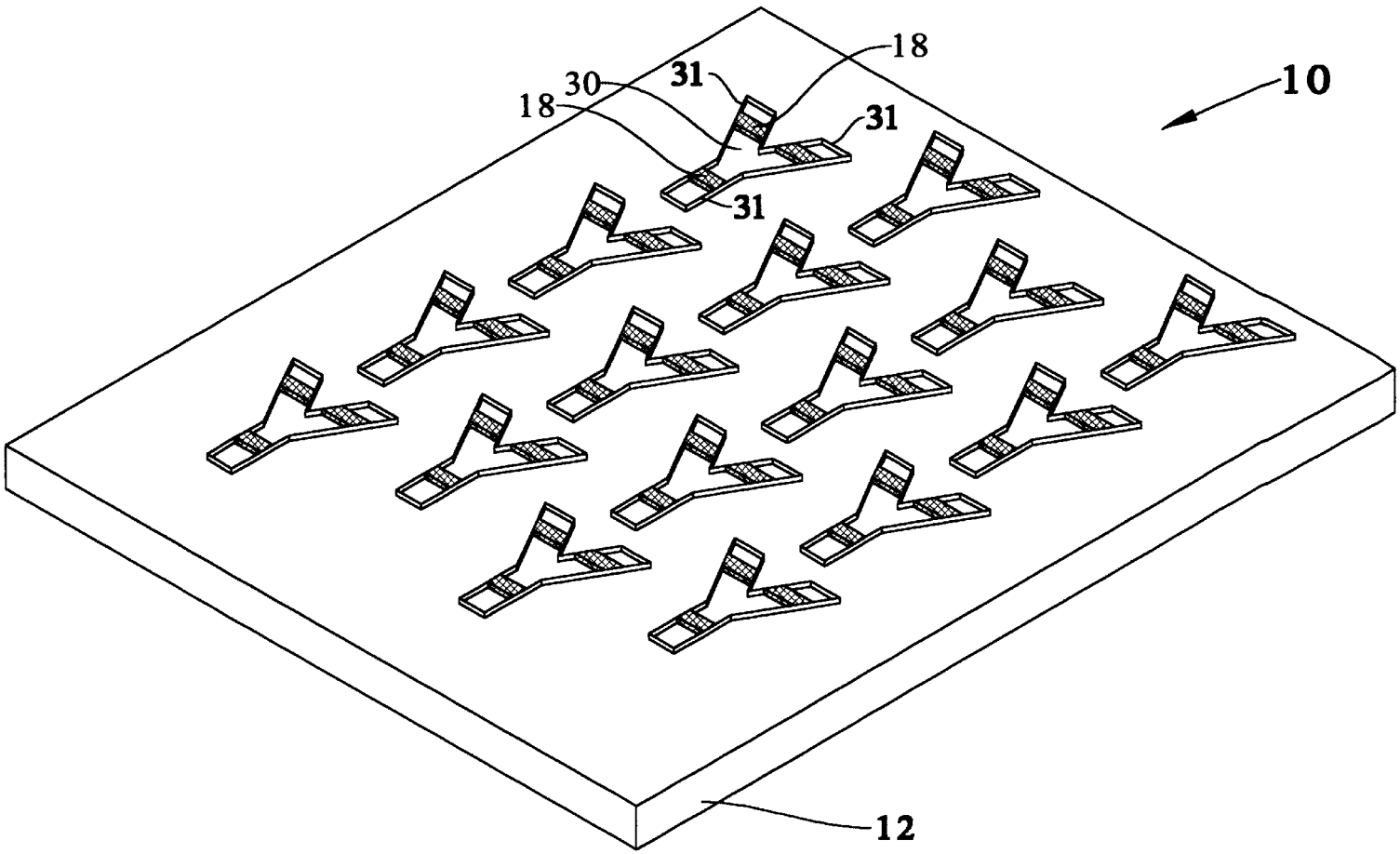
FIG. 9 shows an opto-electronically controlled frequency selective surface having Y-shaped loop type radio frequency scattering elements.
Figure 10:
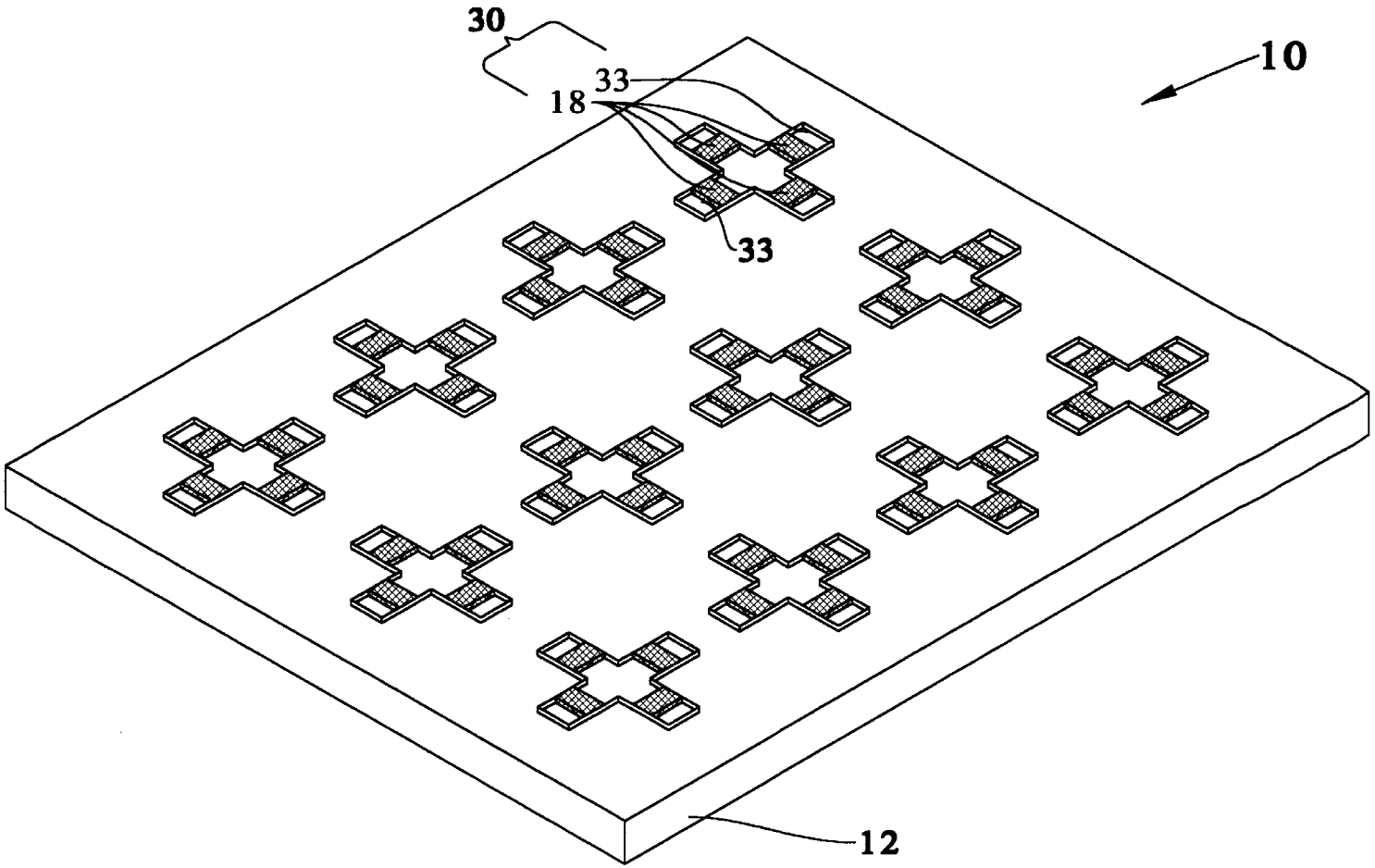
FIG. 10 shows an opto-electronically controlled frequency selective surface having cross-shaped loop type radio frequency scattering elements.
Figure 11:
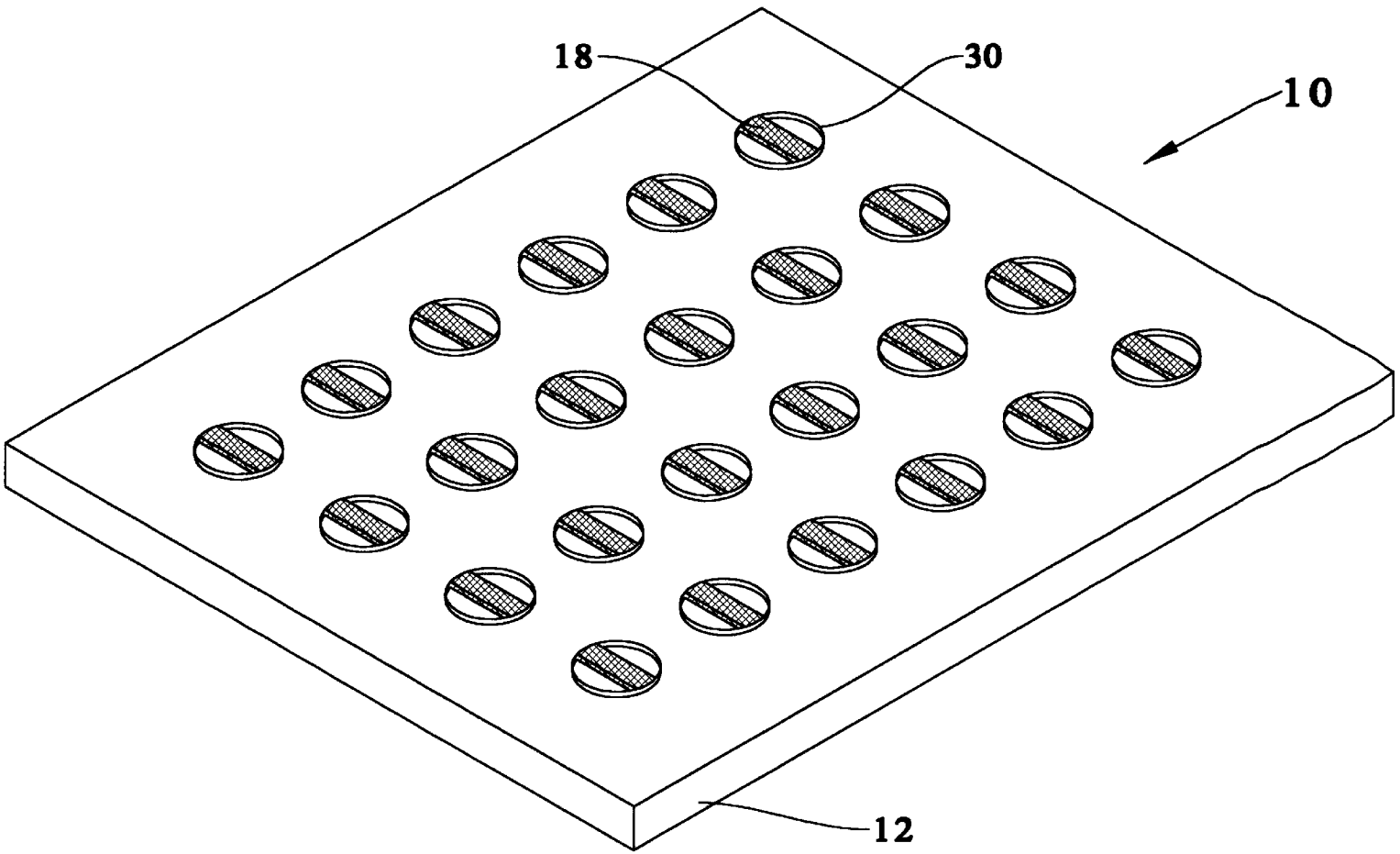
FIG. 11 shows an opto-electronically controlled frequency selective surface having circularly shaped loop type radio frequency scattering elements.

In FIG. 6, the loops 30 are shown generally formed in the shape of rectangles. However, loops 30 may have any suitable shape. For example, the loops 30 may be: a) Y-shaped and have a PCE 18 interconnected to one or more legs 31 comprising the loop as shown in FIG. 8; b) cross-shaped and having a PCE 18 interconnected to one or more legs 33 comprising the loop as shown in FIG. 9; or c) circularly shaped and having a PCE 18 interconnected across the loop as shown in FIG. 10. By way of example, each leg 31 of Y-shaped loop 30 may have a length of about $\lambda/4$; each leg 33 comprising cross-shaped loop 30 may have a length and width of about $\lambda/2$; and the diameter of the circularly shaped loops 30 may be about $\lambda/2$. Also, loops 30 may be polygonal shaped or shaped as bow-ties.

The present invention may be used as an anti-jam device for an enclosed antenna in which case it would "shield" the antenna from incident electromagnetic radiation. The present invention may also serve as a RADAR signature control device by creating a specular reflection off its surface rather than a diffuse or diffracted reflection to mask the antenna it is shielding. The present invention may also be used to perform electromagnetic beam steering by illuminating selective patterns on the surface of the opto-electronically controlled frequency selective surface 10.

Obviously, many modifications and variations of the present invention are possible in light of the above teachings. For example, the scope of the invention includes the use frequency scattering elements having shapes other than those specifically identified above. Therefore, it is to be understood that within the scope of the appended claims, the invention may be practiced otherwise than as specifically described.

We claim:

1. An opto-electronically controlled frequency selective surface, comprising:

a semiconducting substrate; and radio frequency scattering elements, wherein each said radio frequency scattering element includes:

a track of electrically conductive material formed in a loop and mounted on said semiconducting substrate; and a photo-controlled element electrically connected to said track for changing scattering frequency characteristics of said radio frequency scattering element.

2. The opto-electronically controlled frequency selective surface of claim 1 wherein each said loop is configured to have a shape selected from the group that includes a rectangular shape, Y-shape, bow-tie shape, polygonal shape, cross-shape, and circular shape.

3. The opto-electronically controlled frequency selective surface of claim 1 wherein said photo-controlled element is selected from the group that includes bulk semiconductor switches, photocells, photodiodes, phototransistors, and photovoltaic controlled field effect transistors.

4. The opto-electronically controlled frequency selective surface of claim 3 wherein said field effect transistors are selected from the group that includes high electron mobility transistors, metal semiconductor field effect transistors, and metal oxide semiconductor field effect transistors.

5. An opto-electronically controlled frequency selective surface, comprising:

a dielectric substrate; and radio frequency scattering elements, wherein each said radio frequency scattering element includes:

a track of electrically conductive material formed in a loop and mounted on said dielectric substrate; and a photo-controlled element electrically connected to said track for changing scattering frequency characteristics of said radio frequency scattering element.

6. The opto-electronically controlled frequency selective surface of claim 5 wherein said photo-controlled element is selected from the group that includes bulk semiconductor switches, photocells, photodiodes, phototransistors, and photovoltaic controlled field effect transistors.

7. The opto-electronically controlled frequency selective surface of claim 5 wherein said field effect transistors are selected from the group that includes high electron mobility transistors, metal semiconductor field effect transistors, and metal oxide semiconductor field effect transistors.

8. The opto-electronically controlled frequency selective surface of claim 5 wherein each said loop has a shape selected from the group that includes a rectangular shape, Y-shape, cross-shape, bow-tie shape, polygonal shape, and circular shape.

* * * * *